US008322183B2

(12) United States Patent
Myers et al.

(10) Patent No.: US 8,322,183 B2
(45) **Date of Patent: *Dec. 4, 2012**

(54) MANUFACTURING PROCESS TO PRODUCE A NECKED CONTAINER

(75) Inventors: Gary L. Myers, Sarver, PA (US); Anthony Fedusa, Lower Burrell, PA (US); Robert E. Dick, Cheswick, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/767,190

(22) Filed: Apr. 26, 2010

(65) Prior Publication Data

US 2010/0199741 A1 Aug. 12, 2010

Related U.S. Application Data

(63) Continuation of application No. 11/383,515, filed on May 16, 2006, now Pat. No. 7,726,165.

(51) Int. Cl.
*B21D 22/28* (2006.01)

(52) U.S. Cl. ..... 72/348; 72/467; 413/69

(58) Field of Classification Search ..... 72/347, 72/348, 356, 379.4, 467; 413/69, 76
See application file for complete search history.

(56) References Cited

U.S. PATENT DOCUMENTS

| | | | | |
|---|---|---|---|---|
| 3,759,205 | A | 9/1973 | Dolveck | |
| 3,857,917 | A * | 12/1974 | Reade | 264/560 |
| 3,898,828 | A | 8/1975 | Cassai et al. | |
| 3,995,572 | A | 12/1976 | Saunders | |
| 4,163,380 | A * | 8/1979 | Masoner | 72/342.1 |
| 4,173,883 | A | 11/1979 | Boik | |
| 4,947,667 | A | 8/1990 | Gunkel et al. | |
| 5,040,682 | A | 8/1991 | Palisin, Jr. et al. | |
| 5,058,408 | A | 10/1991 | Leftault, Jr. et al. | |
| 5,160,031 | A | 11/1992 | Palisin, Jr. et al. | |
| 5,261,558 | A | 11/1993 | Claydon | |
| 5,351,852 | A | 10/1994 | Trageser et al. | |
| 5,355,710 | A * | 10/1994 | Diekhoff | 72/379.4 |
| 5,394,727 | A | 3/1995 | Diekhoff et al. | |
| 5,470,405 | A | 11/1995 | Wyatt-Meir et al. | |
| 5,487,295 | A | 1/1996 | Diekhoff et al. | |
| 5,522,248 | A | 6/1996 | Diekhoff et al. | |
| 5,572,893 | A | 11/1996 | Goda et al. | |

(Continued)

FOREIGN PATENT DOCUMENTS

AR 060964 10/2010

(Continued)

OTHER PUBLICATIONS

Chile Patent Application No. 1401-07, Office Action dated Feb. 13, 2009.

(Continued)

*Primary Examiner* — Debra Sullivan
(74) *Attorney, Agent, or Firm* — Greenberg Traurig, LLP

(57) ABSTRACT

The present invention provides a necking system including a plurality of necking dies each necking dies having an at least partially non-polished necking surface and a non-polished relief following the necking surface. The present invention further provides a method of necking a metal container including providing a metal blank; shaping the blank into a bottle stock; and necking the metal bottle stock, wherein necking includes at least one necking die having an at least partially non-polished necking surface.

9 Claims, 8 Drawing Sheets

U.S. PATENT DOCUMENTS

| | | | | |
|---|---|---|---|---|
| 5,645,190 | A | 7/1997 | Goldberg | |
| 5,699,932 | A | 12/1997 | Claydon et al. | |
| 5,711,178 | A | 1/1998 | Hogendoorn et al. | |
| 5,713,235 | A * | 2/1998 | Diekhoff | 72/352 |
| 5,724,848 | A | 3/1998 | Aschberger | |
| 5,727,414 | A | 3/1998 | Halasz et al. | |
| 5,746,080 | A | 5/1998 | Hartman et al. | |
| 5,755,130 | A | 5/1998 | Tung et al. | |
| 5,776,270 | A | 7/1998 | Boindich | |
| 5,822,843 | A | 10/1998 | Diekhoff et al. | |
| 5,832,766 | A | 11/1998 | Hartman et al. | |
| 5,851,685 | A | 12/1998 | McEldowney | |
| 5,899,104 | A | 5/1999 | Brilman et al. | |
| 5,899,105 | A | 5/1999 | Erhard | |
| 5,899,106 | A | 5/1999 | Heurteboust et al. | |
| 5,902,086 | A | 5/1999 | Enoki | |
| 5,916,317 | A | 6/1999 | Willoughby et al. | |
| 5,938,389 | A | 8/1999 | Shore et al. | |
| 5,960,659 | A | 10/1999 | Hartman et al. | |
| 5,970,767 | A | 10/1999 | Hartman et al. | |
| 6,038,910 | A | 3/2000 | McClung | |
| 6,079,244 | A | 6/2000 | Robinson et al. | |
| 6,085,563 | A | 7/2000 | Heiberger et al. | |
| 6,112,932 | A | 9/2000 | Holdren | |
| D435,454 | S | 12/2000 | Munn et al. | |
| 6,250,122 | B1 | 6/2001 | Robinson et al. | |
| 6,286,357 | B1 | 9/2001 | D'Amore et al. | |
| 6,308,545 | B2 | 10/2001 | Burgel et al. | |
| 6,338,263 | B1 | 1/2002 | Obata et al. | |
| 6,343,496 | B1 | 2/2002 | Hanna et al. | |
| D455,961 | S | 4/2002 | Edson et al. | |
| 6,374,657 | B1 | 4/2002 | Kirk et al. | |
| 6,442,991 | B1 | 9/2002 | Rojek | |
| D464,264 | S | 10/2002 | Edson et al. | |
| 6,655,181 | B2 * | 12/2003 | Morales | 72/42 |
| 6,701,764 | B2 | 3/2004 | Bruck et al. | |
| D490,317 | S | 5/2004 | Chang | |
| 6,779,677 | B2 | 8/2004 | Chupak | |
| 6,802,196 | B2 | 10/2004 | Gong et al. | |
| 6,886,722 | B2 | 5/2005 | Flecheux | |
| 6,907,653 | B2 | 6/2005 | Chupak | |
| 6,945,085 | B1 | 9/2005 | Goda | |
| D512,315 | S | 12/2005 | Holm | |
| D514,937 | S | 2/2006 | Chang | |
| 7,003,999 | B2 | 2/2006 | Campo et al. | |
| 7,004,000 | B2 | 2/2006 | Campo et al. | |
| 7,188,499 | B2 | 3/2007 | Ogaki et al. | |
| 7,670,094 | B2 | 3/2010 | Bolthauser | |
| 7,726,165 | B2 | 6/2010 | Myers | |
| 2001/0022103 | A1 | 9/2001 | Zeiter et al. | |
| 2001/0040167 | A1 | 11/2001 | Flecheux | |
| 2002/0162371 | A1 | 11/2002 | Hamstra et al. | |
| 2003/0074946 | A1 | 4/2003 | Campo et al. | |
| 2003/0102278 | A1 | 6/2003 | Chupak | |
| 2003/0115923 | A1 | 6/2003 | Veen et al. | |
| 2004/0011112 | A1 | 1/2004 | Lentz et al. | |
| 2004/0035871 | A1 | 2/2004 | Chupak | |
| 2004/0040970 | A1 | 3/2004 | Weijers et al. | |
| 2004/0187536 | A1 | 9/2004 | Gong et al. | |
| 2004/0194522 | A1 | 10/2004 | Hamstra et al. | |
| 2004/0216506 | A1 | 11/2004 | Simpson et al. | |
| 2004/0231395 | A1 | 11/2004 | Barber | |
| 2005/0000260 | A1 | 1/2005 | Campo et al. | |
| 2005/0193796 | A1 | 9/2005 | Heiberger et al. | |
| 2005/0235726 | A1 | 10/2005 | Chupak | |
| 2006/0071035 | A1 | 4/2006 | Christ et al. | |
| 2007/0266758 | A1 | 11/2007 | Myers et al. | |
| 2007/0271993 | A1 | 11/2007 | Druesne et al. | |
| 2007/0295051 | A1 | 12/2007 | Myers et al. | |
| 2008/0022746 | A1 | 1/2008 | Myers et al. | |
| 2008/0116212 | A1 | 5/2008 | Jonker | |
| 2009/0274957 | A1 | 11/2009 | Goda et al. | |
| 2010/0199741 | A1 | 8/2010 | Myers et al. | |

FOREIGN PATENT DOCUMENTS

| | | |
|---|---|---|
| AU | 2007254362 | 12/2010 |
| CL | 169996 | 9/1996 |
| CL | 220696 | 11/1996 |
| CL | 223496 | 12/1996 |
| CL | 241899 | 10/1999 |
| CL | 248600 | 10/2000 |
| CL | 04402005 | 3/2005 |
| DE | 4113428 | 10/1992 |
| EP | 492861 | 7/1992 |
| EP | 599583 | 6/1994 |
| EP | 721384 | 8/1994 |
| EP | 0750953 | 1/1997 |
| EP | 767241 | 4/1997 |
| EP | 845315 | 6/1998 |
| EP | 852973 | 7/1998 |
| EP | 852974 | 7/1998 |
| EP | 854823 | 7/1998 |
| EP | 1064413 | 1/2001 |
| EP | 0853513 | 8/2001 |
| EP | 928229 | 8/2001 |
| EP | 0853514 | 10/2001 |
| EP | 0853515 | 10/2001 |
| EP | 1294622 | 3/2003 |
| EP | 1506824 | 2/2005 |
| EP | 1461262 | 2/2007 |
| EP | 1586393 | 9/2007 |
| EP | 2111935 | 10/2009 |
| FR | 2495507 | 6/1982 |
| FR | 2762383 | 10/1998 |
| ID | P0026760 | 10/2010 |
| JP | 7185707 | 7/1995 |
| JP | 07242226 | 9/1995 |
| JP | 2000015371 | 1/2000 |
| WO | 9111274 | 8/1991 |
| WO | 9111275 | 8/1991 |
| WO | 91/14626 | 10/1991 |
| WO | 9322079 | 11/1993 |
| WO | 9505253 | 2/1995 |
| WO | 9515227 | 6/1995 |
| WO | 9615865 | 5/1996 |
| WO | 9625256 | 8/1996 |
| WO | 9640457 | 12/1996 |
| WO | 9711889 | 4/1997 |
| WO | 9712704 | 4/1997 |
| WO | 9712705 | 4/1997 |
| WO | 9712706 | 4/1997 |
| WO | 9747408 | 12/1997 |
| WO | 9805445 | 2/1998 |
| WO | 9839117 | 9/1998 |
| WO | 9843757 | 10/1998 |
| WO | 9932242 | 7/1999 |
| WO | 9937826 | 7/1999 |
| WO | 0151231 | 7/2001 |
| WO | 0158618 | 8/2001 |
| WO | 0196209 | 12/2001 |
| WO | 03039975 | 5/2003 |
| WO | 03047991 | 6/2003 |
| WO | 2004058597 | 7/2004 |
| WO | 2005000498 | 1/2005 |
| WO | 2005099926 | 10/2005 |
| WO | 2006040116 | 4/2006 |
| WO | 2006078690 | 7/2006 |
| WO | 2008110679 | 9/2008 |
| WO | 2009130034 | 10/2009 |
| ZA | 200810096 | 12/2009 |

OTHER PUBLICATIONS

China Patent Application No. 200780023916.7, Office Action, dated Jan. 22, 2010.

China Patent Application No. 200780024186.2, Office Action, dated Feb. 12, 2010.

China Patent Application No. 200780024250.7, Office Action, dated Jan. 22, 2010.

Egyptian Application No. 2008/12/2088, Office Action, dated Mar. 16, 2010.

Eurasia Patent Application No. 200870536/30, Office Action, dated Dec. 15, 2009.

European Patent Application No. 07 777 035.2, Office Action, dated Jan. 8, 2010.

Examiner's Report related to corresponding Chile Patent Application No. 1401-07 dated Feb. 13, 2009, along with Letter of Clarke, Modet & Co., dated Mar. 30, 2009.
Malaysia Patent Application No. PI 20085324, Office Action, mailed Nov. 13, 2009.
Malaysia Patent Application No. PI 20085325, Office Action, mailed Sep. 4, 2009.
U.S. Appl. No. 12/767,190, Office Action, mailed Sep. 1, 2010.
U.S. Appl. No. 11/474,581, Office Action, mailed Nov. 23, 2009.
U.S. Appl. No. 11/768,267, Office Action, mailed Jan. 27, 2010.
U.S. Appl. No. 11/474,581, Office Action, dated Apr. 24, 2009.
U.S. Appl. No. 11/474,581, Office Action, dated Mar. 17, 2008.
U.S. Appl. No. 11/474,581, Office Action, dated Oct. 9, 2008.
U.S. Appl. No. 11/768,267, Office Action, dated Mar. 17, 2008.
U.S. Appl. No. 11/768,267, Office Action, dated May 14, 2009.
U.S. Appl. No. 11/768,267, Office Action, dated Oct. 9, 2008.
Vietnam Patent Application No. 1-2009-00143, Office Action, dated Nov. 23, 2010.
Canada Patent Application No. 2,651,778, Office Action, dated Apr. 7, 2010.
Eurasia Patent Application No. 200870536/30, Office Action, datedSep. 15, 2010.
Korea Patent Application No. 2008-7028885, Office Action, dated Nov. 17, 2010.
Australia Patent Application No. 2007254362, Office Action, dated Mar. 31, 2010.
Australia Patent Application No. 2007265132, Office Action, dated May 10, 2010.
Australia Patent Application No. 2007265347, Office Action, dated May 10, 2010.
Canada Patent Application No. 2,655,908, Office Action, dated Apr. 13, 2010.
Canada Patent Application No. 2,655,925, Office Action, dated Apr. 15, 2010.
Egyptian Application No. 2008/122030, Office Action, dated Jun. 2, 2010.
European Patent Application No. 07 779 7928.4, Office Action, dated May 5, 2010.
European Patent Application No. 07 779 9029.9, Office Action, dated May 5, 2010.
Indonesian Patent Application W-00200803711, Office Action, dated Apr. 16, 2010.
Indonesian Patent Application W-00200804206, Office Action, dated Mar. 22, 2010.
New Zealand Patent Application No. 573303, Office Action, dated Apr. 30, 2010.
New Zealand Patent Application No. 574204, Office Action, dated Jun. 17, 2010.
New Zealand Patent Application No. 574797, Office Action, dated Jun. 17, 2010.
U.S. Appl. No. 11/383,515, Office Action, dated Apr. 28, 2008.
U.S. Appl. No. 11/383,515, Office Action, dated Dec. 29, 2008.
U.S. Appl. No. 11/383,515, Office Action, dated Apr. 17, 2007.
U.S. Appl. No. 11/383,515, Office Action, dated Jul. 21, 2009.
U.S. Appl. No. 11/383,515, Office Action, dated Sep. 5, 2007.
European Search Report dated Apr. 30, 2012 relating to EP Application No. EP 12150086, including Annex and Preliminary Examination Report.

* cited by examiner

MANUFACTURING PROCESS TO PRODUCE A NECKED CONTAINER

CROSS-REFERENCE TO RELATED APPLICATIONS

The present application is a continuation of U.S. patent application Ser. No. 11/383/515, entitled "MANUFACTURING PROCESS TO PRODUCE A NECKED CONTAINER", filed May 16, 2006, now U.S. Pat. No. 7,726,165, which is incorporated herein by reference in its entirety. The present application is also related to PCT Patent Application No. PCT/US2007/11549 entitled "MANUFACTURING PROCESS TO PRODUCE A NECKED CONTAINER", filed May 14, 2007, which is also incorporated herein by reference in its entirety.

FIELD OF THE INVENTION

This invention relates to necking dies for beverage container and aerosol container production.

BACKGROUND OF THE INVENTION

Beverage cans for various soft drinks or beer are generally formed by drawn and iron technology (i.e., the DI can), in which the can trunk (or side wall portion) and the can bottom are integrally formed by drawing and ironing a metallic sheet, such as an aluminum alloy sheet or a surface-treated steel sheet.

An alternative to conventional DI cans include bi-oriented molded container made of a polyethylene terephthalate resin (i.e., the PET bottle). However, PET bottles are considerably less recyclable than their aluminum DI can counterparts.

Therefore, it has been investigated to utilize drawn and iron technology to provide containers having the geometry of PET bottles composed of a recyclable metal. One disadvantage of forming metal bottles using DI technology is the time and cost associated with the necking process. Necking typically includes a series of necking dies and knockouts that progressively decrease the diameter of the bottle's neck portion to a final dimension. Typically, the necking process for a 53 mm bottle style can requires on the order of 28 necking dies and knockouts to reduce the can diameter from approximately 53 mm to a final opening diameter of approximately 26 min.

The manufacturing cost associated with the production of 28 necking dies and knockouts is disadvantageously high. In each of the prior necking dies the necking surface is typically polished to a very smooth finished surface (i.e. Ra 2-4 μin) adding to the cost of the necking system. Additionally, the time required to neck the can bodies through 28 or more necking dies can be considerable also contributing to the production cost of the aluminum bottles. Finally, additional necking stations may require a substantial capital investment.

In light of the above comments, a need exists for a method of manufacturing aluminum bottles having a reduced number of necking dies, hence having a decreased production cost.

SUMMARY OF THE INVENTION

Generally speaking, the present invention provides a necking die design allowing for more aggressive reduction per necking die for necking metal bottles.

Broadly, the necking die includes at least a partially non-polished necking surface and a non-polished relief following the necking surface.

The at least partially non-polished necking surface includes a non-polished land, polished neck radius portion and polished shoulder radius portion. The non-polished land has a geometry and a surface finish that provides for necking without collapse of the structure being necked.

For the purposes of this disclosure, the term "polished" represents that the surface has a smooth machined surface finish, wherein the surface roughness (Ra) ranges from about 2-6 μin. For the purposes of this disclosure, the term "non-polished" denotes that the surface has a rough surface, wherein the surface roughness (Ra) is greater than about 8 μin.

In another aspect of the present invention, a necking system is provided incorporating the above described necking die. Broadly, the necking system includes:

a plurality of necking dies each necking die having an at least partially non-polished necking surface and a non-polished relief following the necking surface.

The reduction in the necking dies having an at least partially non-polished surface in accordance with the present invention is higher than the degree of reduction employed with conventional polished necking dies.

For the purposes of this disclosure, the term "reduction" corresponds to a geometry of the necking surface in the die that reduces the diameter of the can body at its neck end. In the system of dies, the reduction provided by each successive die results in the final dimension of the bottle neck.

In another aspect of the present invention, a necking method is provided using a necking die system, as described above, in which the necking system employs necking dies including a level of reduction that was not possible with prior systems.

Broadly, the necking method includes:

providing a metal blank;

shaping the metal blank into a bottle stock; and necking the bottle stock, wherein necking comprises at least one necking die having an at least partially non-polished necking surface.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION OF PREFERRED EMBODIMENTS

Figure 1:
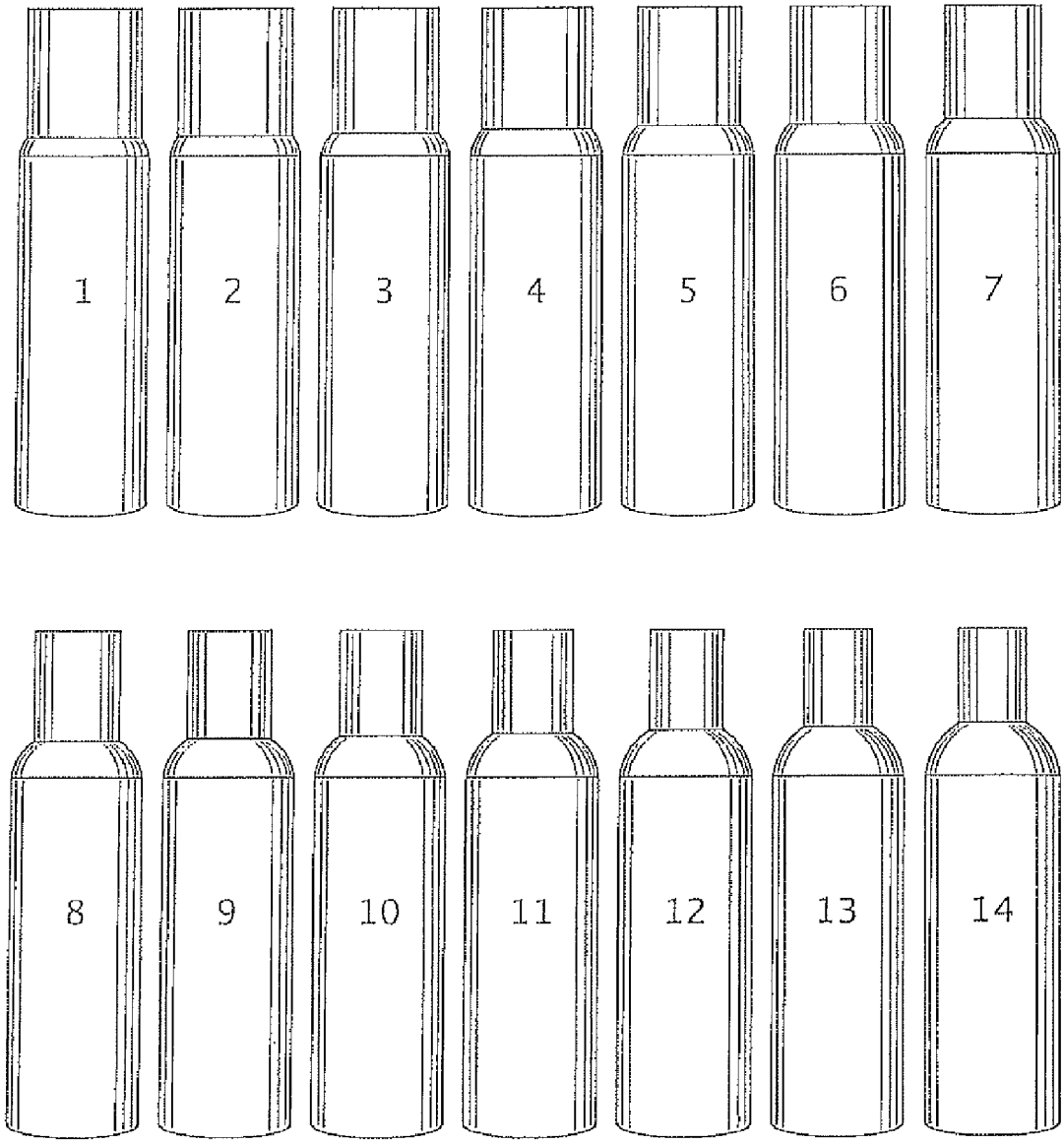
FIG. 1 depicts a pictorial representation of a 14 stage die necking progression for a 53 mm diameter can body in accordance with the present invention.

FIG. 1 depicts a bottle stock after each stage of necking by a necking system in accordance with the present invention, in which the inventive necking system provides for a more aggressive necking reduction scheme than was previously available with prior necking systems. FIG. 1 depicts the progression of necking from an initial necking die to produce the first necked bottle stock 1 to a final necking die to produce the final necked bottle stock 14. Although FIG. 1 depicts a necking system including 14 stages, the following disclosure is not intended to be limited thereto, since the number of necking stages may vary depending on the material of the bottle stock, the bottle stock's sidewall thickness, the initial diameter of the bottle stock, the final diameter of the bottle, the required shape of the neck profile, and the necking force. Therefore, any number of necking dies has been contemplated and is within the scope of the present invention, so long as the progression provides for necking without collapse of the bottle stock.

Figure 2:
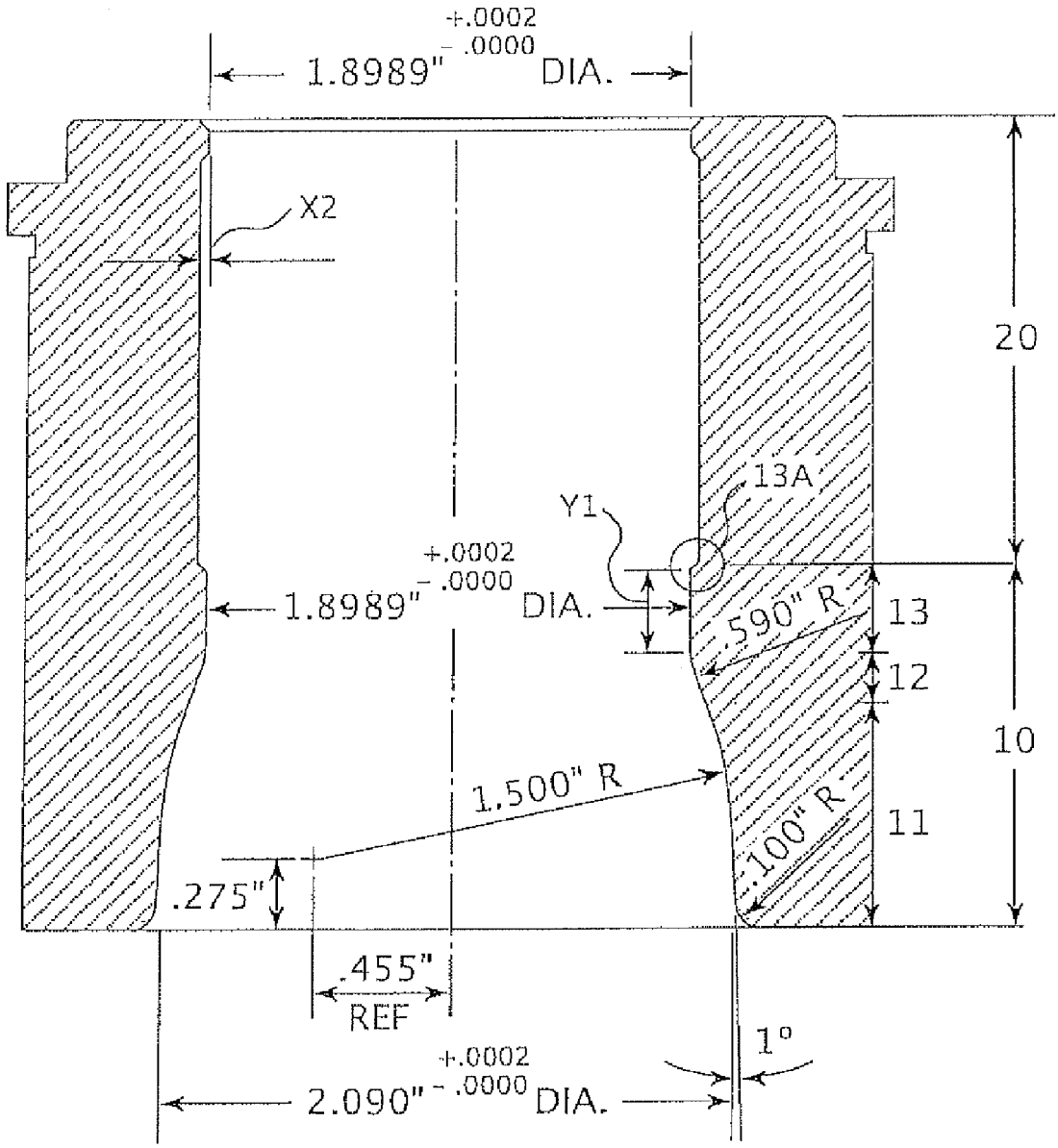
FIG. 2 represents a cross-sectional side view of one embodiment of an initial necking die in accordance with the present invention.

FIG. 2 depicts a cross sectional view of a necking die including at least a partially non-polished necking surface 10 and a non-polished relief 20 following the necking surface 10. In one embodiment, the partially non-polished necking surface 10 includes a shoulder radius portion 11, a neck radius portion 12, and a land portion 13.

One aspect of the present invention is a necking die design in which a partially non-polished necking surface 10 reduces surface contact between the necking surface and the bottle stock being necked in a manner that reduces the force that is required to neck the bottle (hereafter referred to as "necking force"). It has unexpectedly been determined that a necking surface having a rougher surface provides less resistance to a bottle stock being necked than a polished surface. As opposed to the prior expectation that a smooth surface would provide less resistance and hence require less necking force, it has been determined that a smooth surface has greater surface contact with the bottle being necked resulting in greater resistance and requiring greater necking force. In the present invention, the increased surface roughness reduces the surface contact between the necking surface and the bottle being necked, hence reducing the required necking force.

Reducing the necking force required to neck the bottle stock allows for necking dies having a more aggressive degree of reduction than previously available in prior necking dies.

Figure 3:
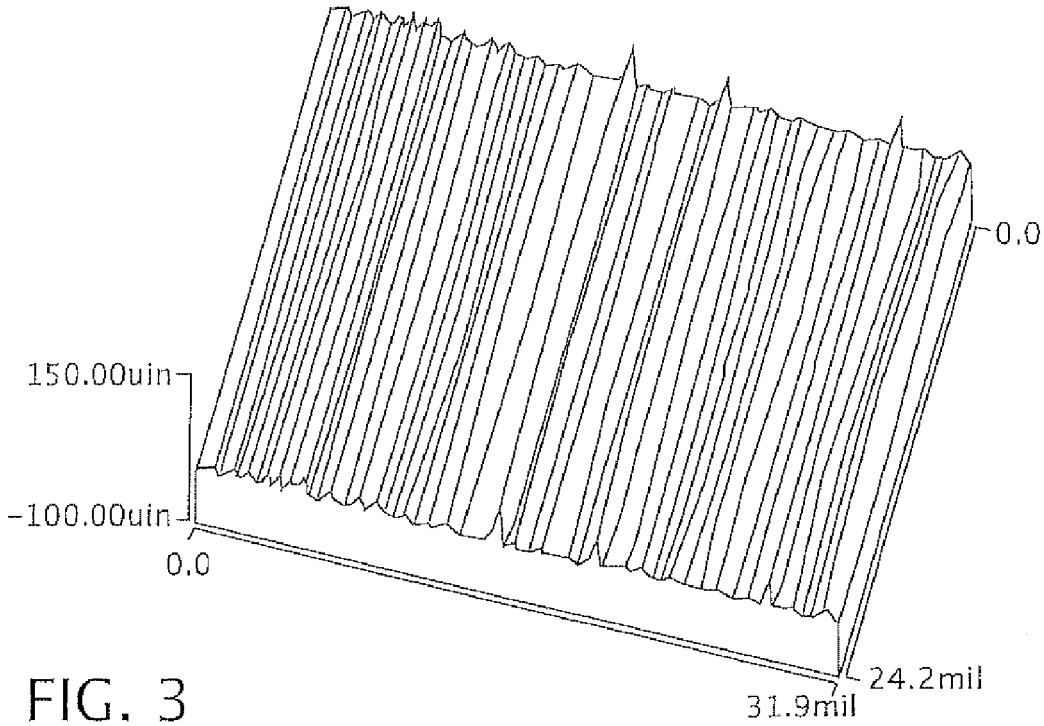
FIG. 3 represents a surface mapping of one embodiment of a polished necking surface, in accordance with the present invention.
Figure 4:
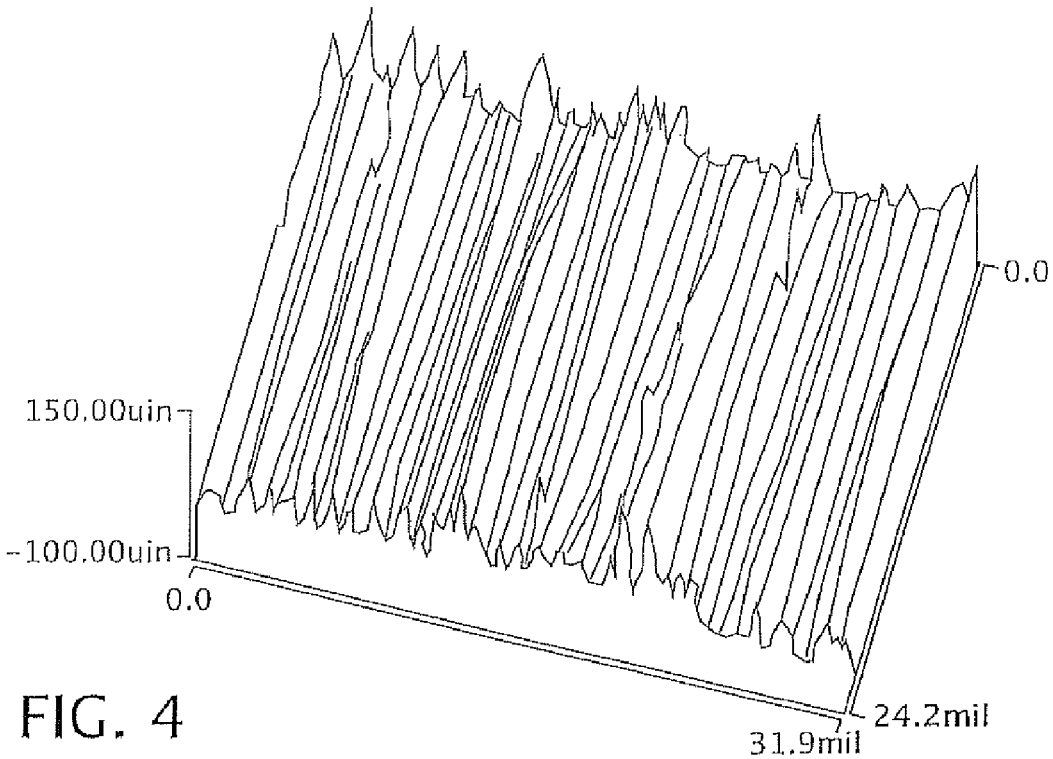
FIG. 4 represents a surface mapping of one embodiment of a non-polished necking surface, in accordance with the present invention.

In one embodiment, a non-polished surface has a surface roughness average (Ra) ranging from more than or equal to 8 μin to less than or equal to 32 μin so long as the non-polished necking surface does not disadvantageously disrupt the aesthetic features of the bottle stock's surface (coating) finish in a significantly observable manner. In one embodiment, a polished surface has a surface roughness average (Ra) finish ranging from 2 μin to 6 μin. FIG. 3 represents a surface mapping of one embodiment of a polished land portion 13 of the necking die generated by ADE/Phase Shift Analysis and MapVue EX-Surface Mapping Software. In this example, the surface roughness (Ra) value was approximately 4.89 μin. FIG. 4 represents a surface mapping of one embodiment of a non-polished land portion 13 of the necking die, in accordance with the present invention generated by ADE/Phase Shift Analysis and MapVue EX-Surface Mapping Software. In this example, the surface roughness (Ra) value was approximately 25.7 μin.

Figure 2A:
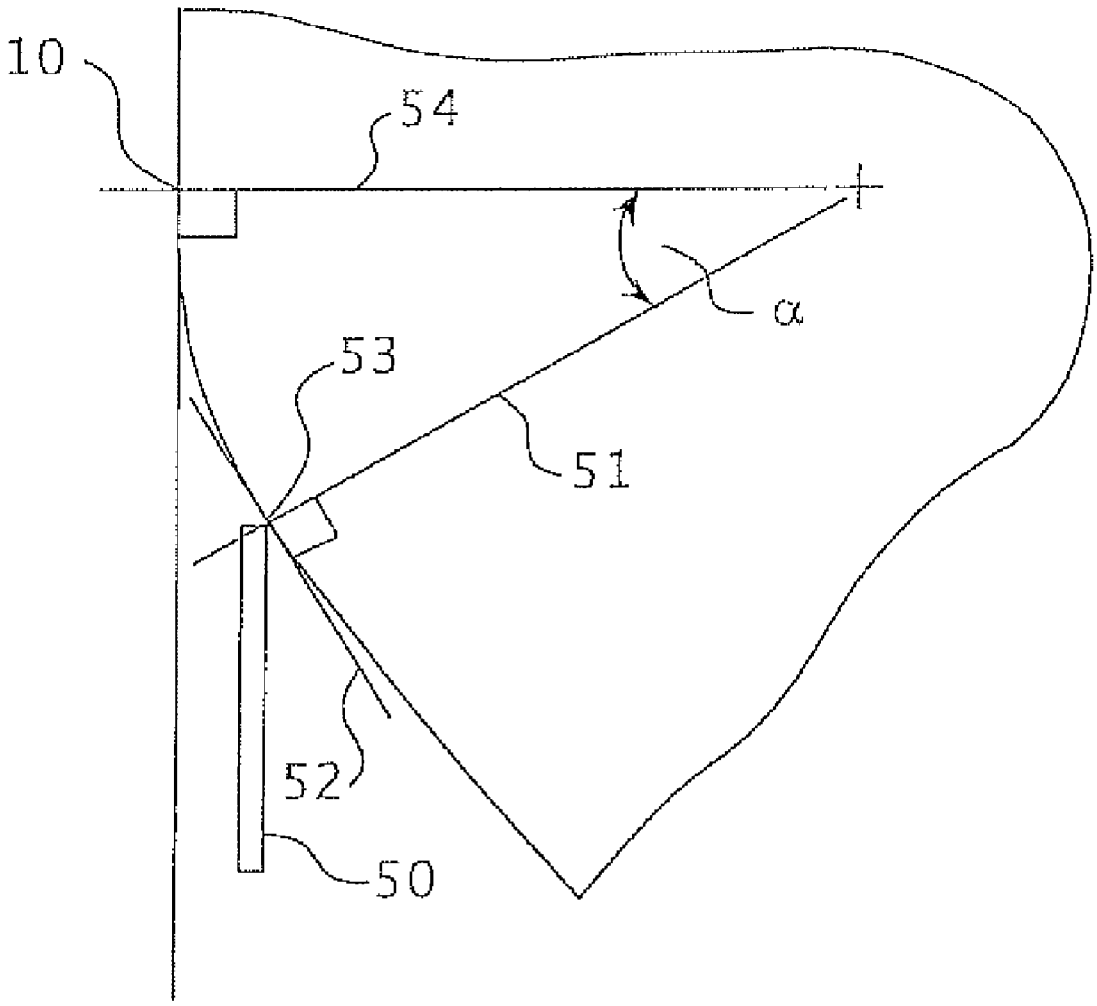
FIG. 2*a* represents a magnified view of the contact angle.

Referring to FIG. 2, in one embodiment, the partially non-polished necking surface 10 includes a non-polished land portion 13, a polished neck radius portion 12, and a polished shoulder radius portion 11. In another embodiment, the at least partially non-polished necking surface 10 may be entirely non-polished. The contact angle $\alpha$ of the bottle stock to the necking surface 10 may be less than 32°, wherein the contact angle is the angle formed by a ray 54 perpendicular to the necking surface at the land portion 13 with a ray 51 extending perpendicular from the plane tangent 52 to the point of contact 53 by the bottle stock 50 to the necking surface, as depicted in FIG. 2*a*.

The non-polished land portion 13 in conjunction with the knockout (not shown) provide a working surface for forming an upper portion of the bottle stock into a bottle neck during necking. In one embodiment, the non-polished land 13 extends from tangent point of neck radius portion 12 of the die wall parallel to the center line of the necking die. The non-polished land portion 13 may extend along the necking direction (along the y-axis) by a distance Y1 being less than 0.5", preferably being on the order of approximately 0.0625". It is noted that the dimensions for the non-polished land portion 13 are provided for illustrative purposes only and are not deemed to limit the invention, since other dimensions for the land have also been contemplated and are within the scope of the disclosure, so long as the dimensions of the land are suitable to provide a necking action when employed with the knockout.

Another aspect of the present invention is a relief 20 positioned in the necking die wall following the necking surface 10. The dimensions of the relief 20 are provided to reduce frictional contact with the bottle stock and the necking die, once the bottle stock has been necked through the land 13 and knockout. Therefore, in some embodiments, the relief 20 in conjunction with the partially non-polished necking surface 10 contributes to the reduction of frictional contact between the necking die wall and the bottle stock being necked, wherein the reduced frictional contact maintains necking performance while reducing the incidence of collapse and improving stripping of the bottle stock.

In one embodiment, the relief 20 extends into the necking die wall by a dimension X2 of at least 0.005 inches measured from the base 13*a* of the land 13. The relief 20 may extend along the necking direction (along the y-axis) the entire length of the top portion of the bottle stock that enters the necking die to reduce the frictional engagement between the bottle stock and the necking die wall to reduce the incidence of collapse yet maintain necking performance. In a preferred embodiment, the relief 20 is a non-polished surface.

In another aspect of the present invention, a necking system is provided in which at least one of the necking dies of the systems may provide an aggressive reduction in the bottle stock diameter. Although FIG. 2 represents an introductory die, the above discussion regarding the shoulder radius 11, neck radius 12, land 13 and relief 20 is equally applicable and may be present in each necking die of the necking system. The geometry of the necking surface of at least one of the successive dies provides for increasing reduction, wherein the term "reduction" corresponds to decreasing the bottle stock diameter from the bottle stock's initial diameter to a final diameter.

In one embodiment, the introductory die has a reduction of greater than 5%, preferably being greater than 9%. The inside diameter of the top portion of the die is one dimension that is measured in determining the degree of reduction provided. The level of reduction that is achievable by the dies of the necking system is partially dependent on the surface finish of the necking surface, necking force, bottle stock material, bottle stock, required neck profile, and sidewall thickness. In one preferred embodiment, an introductory necking die provides a reduction of greater than 9%, wherein the initial necking die is configured for producing an aluminum bottle necked package from an aluminum sheet composed of an Aluminum Association 3104, having an upper sidewall thickness of at least 0.0085 inch and a post bake yield strength ranging from about 34 to 37 ksi.

Figure 5:
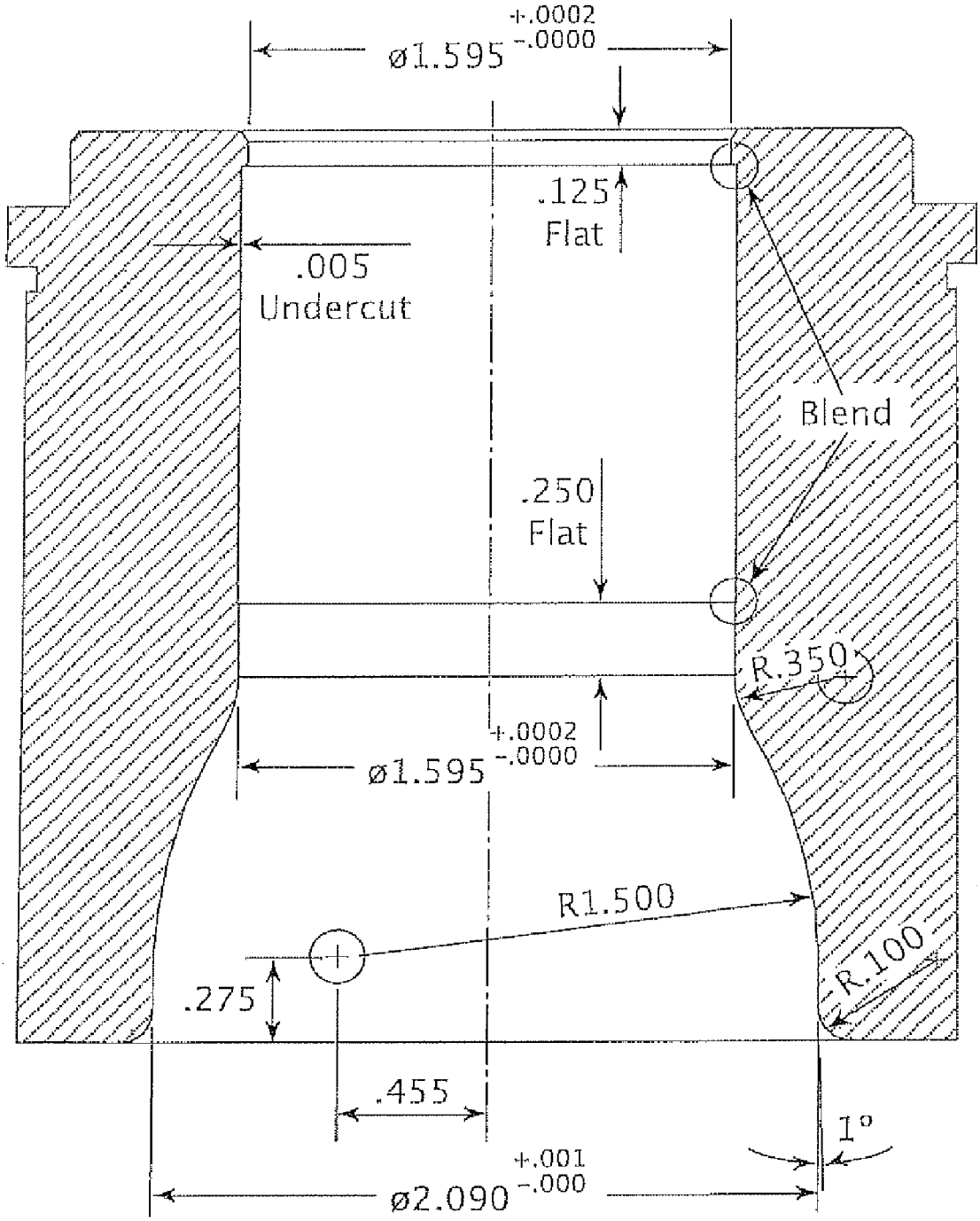
FIG. 5 represents a cross-sectional side view of one embodiment of an intermediate necking die in accordance with the present invention.

FIG. 5 depicts one embodiment of an intermediate die in accordance with the present invention, in which the intermediate necking die may be employed once the bottle stock has been necked with an initial necking die. In comparison to the introductory necking die depicted in FIG. 2, the intermediate necking dies depicted in FIG. 5 provides a less aggressive reduction. In one embodiment, a plurality of intermediate necking dies each provide a reduction ranging from 4% to 7%. The number of intermediate necking dies depends on the bottle stock initial diameter, required final diameter, and neck profile.

Figure 6:
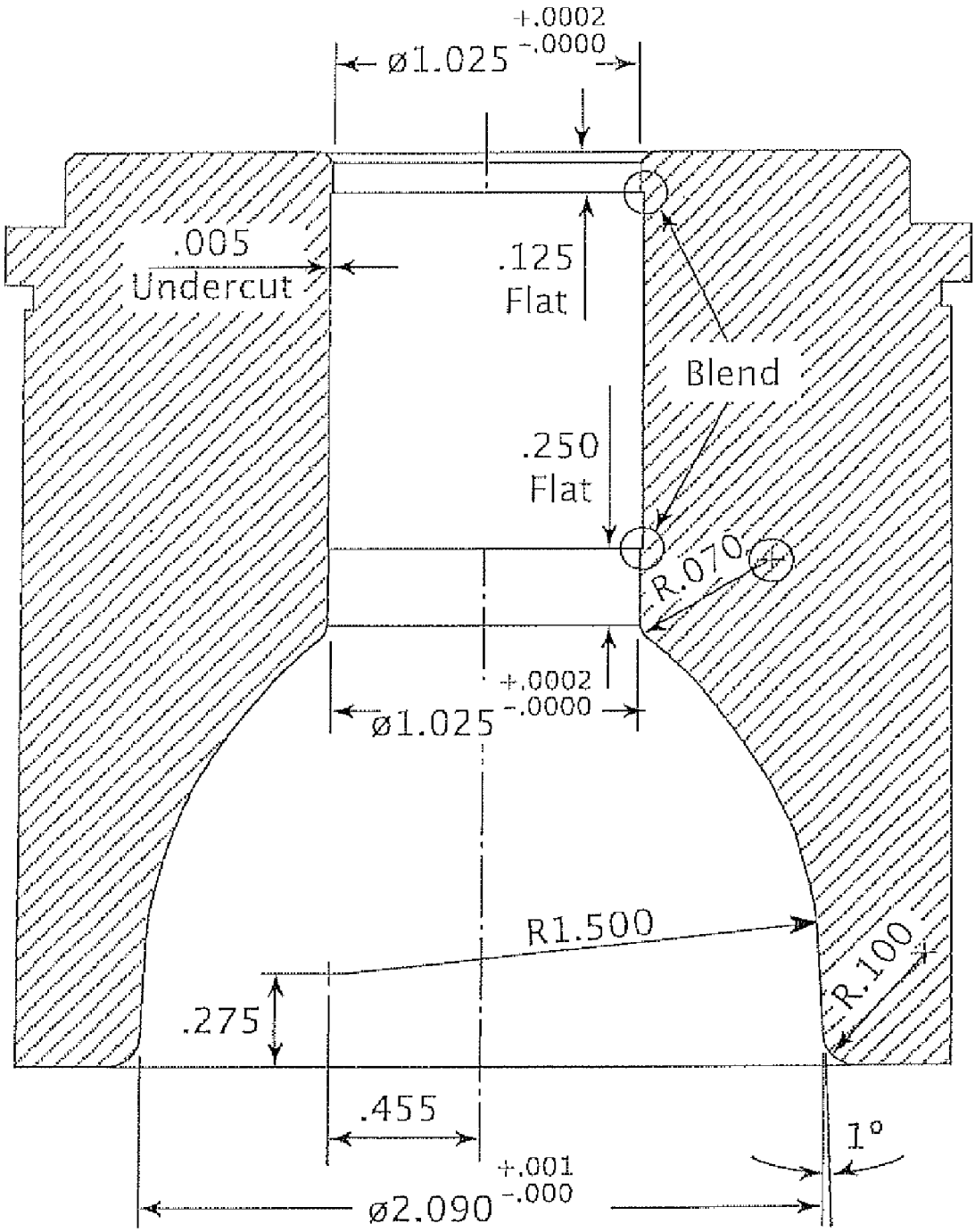
FIG. 6 represents a cross-sectional side view of one embodiment of a final necking die in accordance with the present invention.

FIG. 6 depicts one embodiment of a final necking die in accordance with the present invention. The final necking die is utilized once the bottle stock is finished being necked by the intermediate necking dies. The final necking die has a necking surface that results in the neck dimension of the finished product. In one embodiment, the final necking die provides a reduction of less than 4%. In one embodiment, the final necking die may have a reduction of 1.9%.

In one highly preferred embodiment, a necking system is provided in which the plurality of necking dies include an introductory necking die having a reduction greater than 9%, 12 intermediate dies having a reduction ranging from 4.1 to 6.1%, and a final necking die having a reduction of 1.9%.

In another aspect of the present invention, a method of necking bottles, utilizing a necking system as described above, is provided including the steps of providing an aluminum blank, such as a disc or a slug; shaping the blank into an aluminum bottle stock; and necking the aluminum bottle stock, wherein necking comprises at least one necking die having an at least partially non-polished necking surface.

The present invention provides a necking system including a reduced number of dies and knockouts, therefore advantageously reducing the machine cost associated with tooling for necking operations in bottle manufacturing.

By reducing the number of necking die stages, the present invention advantageously reduces the time associated with necking in bottle manufacturing.

It is noted that the above disclosure is suitable for beverage, aerosol or any other container capable of being necked. Additionally, the above disclosure is equally applicable to drawn and iron and impact extrusion necking methods.

Although the invention has been described generally above, the following examples are provided to further illustrate the present invention and demonstrate some advantages that arise therefrom. It is not intended that the invention be limited to the specific examples disclosed.

EXAMPLE

Table 1 below shows the reduction provided by a 14 stage die necking schedule, in which the necking die geometry was configured to form an aluminum bottle necked package from an aluminum bottle stock having a upper sidewall sheet thickness of approximately 0.0085 inch and a post bake yield strength ranging from about 34 to 37 Ksi. The aluminum composition is Aluminum Association (AA) 3104. As indicated by Table 1, the bottle stock is necked from an initial diameter of approximately 2.0870" to a final diameter of 1.025" without failure, such as wall collapse.

TABLE 1

53 mm Diameter Bottle Stock
14-Stage Die Necking Schedule

| Station Number | Necking Die Entry Diameter (in) | Starting Bottle Stock Diam (in) | Reduction (in) | Final Can Diameter (in) | Percent Reduction (%) | Body Radius (in) | Neck Radius (in) | Neck Angle (degrees) | Knockout Diameter (in) | Contact Angle (degrees) |
|---|---|---|---|---|---|---|---|---|---|---|
| 1 | 2.0900 | 2.0870 | 0.187 | 1.9000 | 8.960 | 1.500 | 0.590 | 72.659 | 1.8798 | 0.000 |
| 2 | 2.0900 | 1.9000 | 0.080 | 1.8200 | 4.211 | 1.500 | 0.500 | 68.828 | 1.8000 | 23.074 |
| 3 | 2.0900 | 1.8200 | 0.075 | 1.7450 | 4.121 | 1.500 | 0.450 | 65.719 | 1.7243 | 23.556 |
| 4 | 2.0900 | 1.7450 | 0.075 | 1.6700 | 4.298 | 1.500 | 0.400 | 62.807 | 1.6495 | 25.008 |
| 5 | 2.0900 | 1.6700 | 0.075 | 1.5950 | 4.491 | 1.500 | 0.350 | 60.022 | 1.5735 | 26.766 |
| 6 | 2.0900 | 1.5950 | 0.075 | 1.5200 | 4.702 | 1.500 | 0.300 | 57.317 | 1.4980 | 28.955 |
| 7 | 2.0900 | 1.5200 | 0.075 | 1.4450 | 4.934 | 1.500 | 0.250 | 54.658 | 1.4223 | 31.788 |
| 8 | 2.0900 | 1.4450 | 0.075 | 1.3700 | 5.190 | 1.500 | 0.250 | 52.588 | 1.3464 | 31.788 |
| 9 | 2.0900 | 1.3700 | 0.075 | 1.2950 | 5.474 | 1.500 | 0.250 | 50.611 | 1.2706 | 31.788 |
| 10 | 2.0900 | 1.2950 | 0.075 | 1.2200 | 5.792 | 1.500 | 0.250 | 48.714 | 1.1944 | 31.788 |
| 11 | 2.0900 | 1.2200 | 0.075 | 1.1450 | 6.148 | 1.500 | 0.250 | 46.886 | 1.1185 | 31.788 |
| 12 | 2.0900 | 1.1450 | 0.050 | 1.0950 | 4.367 | 1.500 | 0.200 | 45.020 | 1.0675 | 28.955 |
| 13 | 2.0900 | 1.0950 | 0.050 | 1.0450 | 4.566 | 1.500 | 0.175 | 43.477 | 1.0164 | 31.003 |
| 14 | 2.0900 | 1.0450 | 0.020 | 1.0250 | 1.914 | 1.500 | 0.070 | 41.363 | 0.9955 | 31.003 |
| | | 1.0250 | | | | | | | | |

Figure 7:
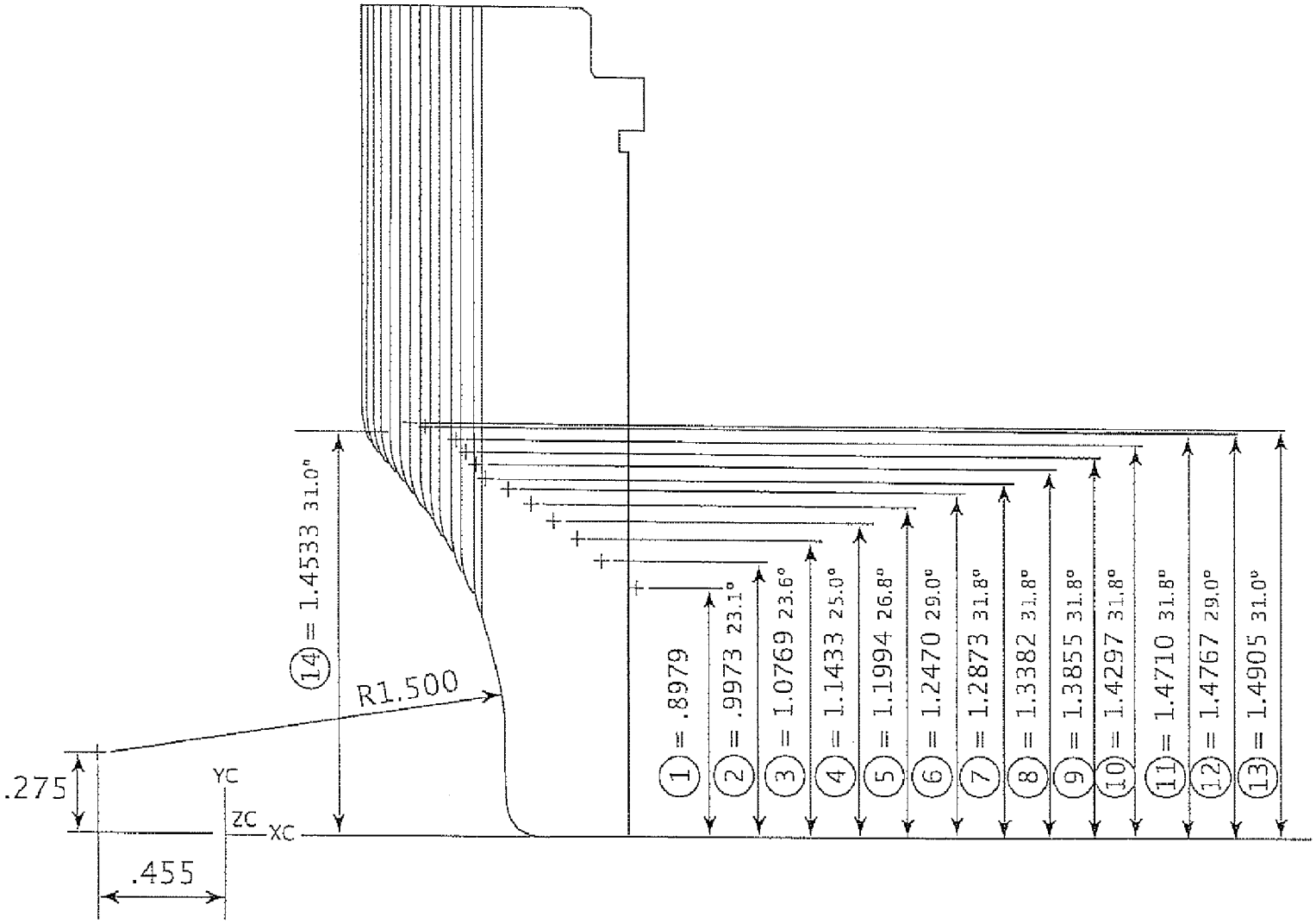
FIG. 7 represents a cross-sectional side view for the shoulder necking surface of each necking die in a 14 stage necking system, in accordance with the present invention.

As depicted in Table 1 the necking system includes a first necking die that provides a reduction of approximately 9%, 12 intermediate dies having a reduction ranging from approximately 4.1 to 6.1%, and a final necking die having a reduction of 1.9%. FIG. 7 represents a cross-sectional side view for the shoulder necking surface of each necking die of the 14 stage necking system represented in Table 1.

Figure 8:
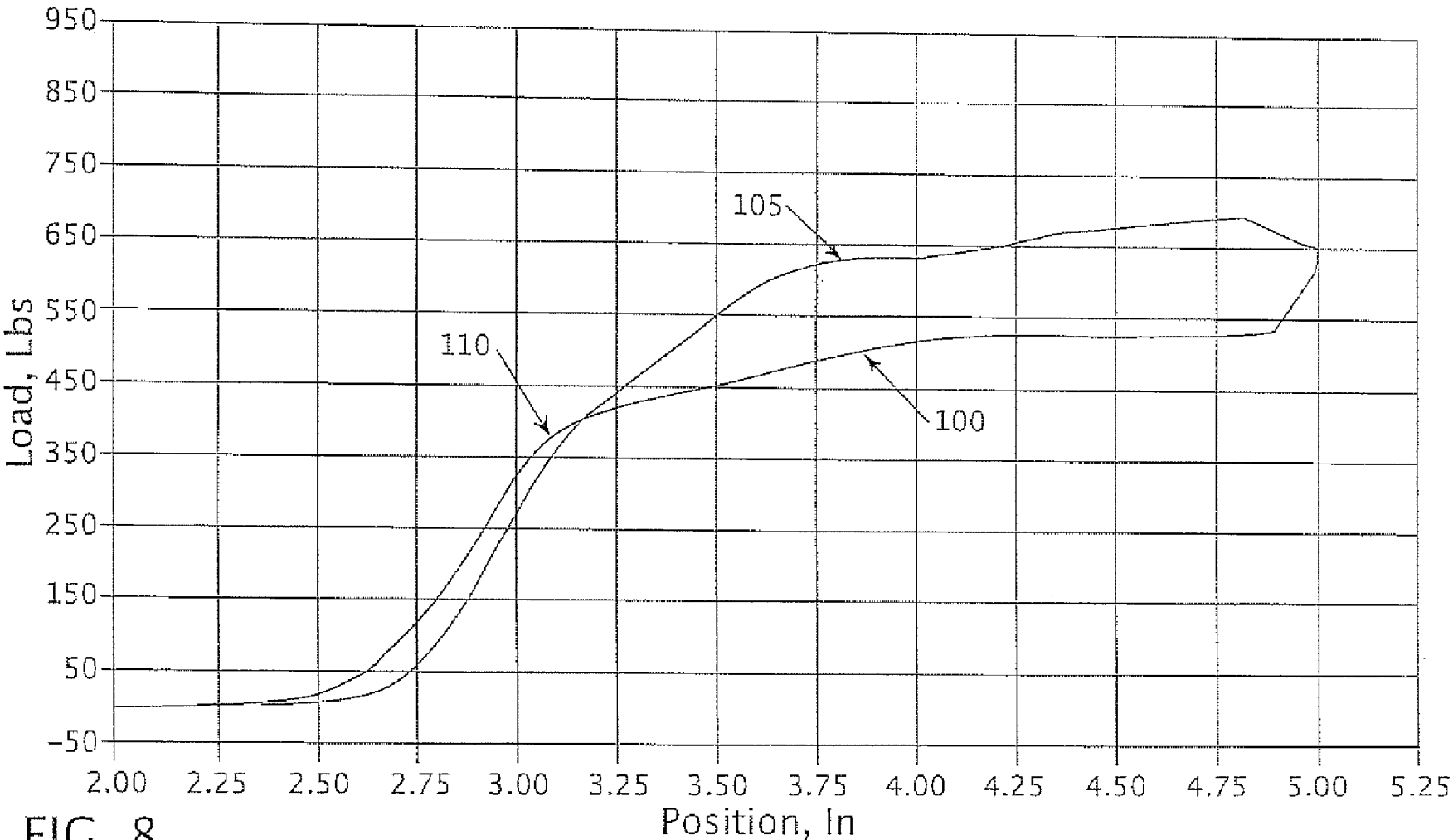
FIG. 8 represents a plot of the necking force required to neck an aluminum bottle into a partially non-polished necking die and the force required to neck a bottle into a polished necking die, wherein the y-axis represents force in pounds (lbs) and the x-axis represents the distance (inches) in which the bottle is inserted into the necking die.

FIG. 8 depicts the force required to neck a bottle into a necking die having a non-polished land in accordance with the invention, as indicated by reference line 100, and the force required to neck an aluminum container into a polished necking die, as indicated by reference line 105, wherein the polished necking die represents a comparative example. The geometry of the necking die having the non-polished land and the control die is similar to the necking die depicted in FIG. 2. The bottle being necked had an upper sidewall sheet thickness of approximately 0.0085 inch, a post bake yield strength of approximately 34 to 37 ksi, and an aluminum composition being Aluminum Association 3104. The thickness of upper sidewall of the aluminum bottle stock being necked had a thickness of approximately 0.0085 inch and a post bake yield strength ranging from about 34 to 37 ksi.

Referring to FIG. 8, a significant decrease in the necking force is realized beginning at the point in which the bottle being necked contacts the non-polished land, as illustrated by data point 110 on the reference line 100, as compared to a polished necking surface, depicted by reference line 105.

Having described the presently preferred embodiments, it is to be understood that the invention may be otherwise embodied within the scope of the appended claims.

What is claimed is:

1. A necking system comprising:

a plurality of necking dies configured for use on an outside of a metal bottle stock, wherein at least one necking die comprises a necking surface and a relief;

wherein the necking surface comprises a land portion, a neck radius portion, and a shoulder radius portion, each having an inner diameter;

wherein the land portion is between the neck radius portion and the relief and the inner diameter of the land is a minimum diameter of the die;

wherein the inner diameters of the neck radius portion and the shoulder radius portion are greater than the inner diameter of the land;

wherein the at least one necking die is dimensioned so that when necking the metal bottle stock, the entire land and the relief travel relative to the bottle stock in an axial direction and at least a portion of the relief travels beyond a top of the bottle stock and the land contacts the outside of the bottle stock; and wherein the land has a surface finish Ra ranging from about 8 μin to about 32 μin.

2. The necking system of claim 1 wherein the neck radius portion and the shoulder radius portion have a surface finish Ra ranging from about 2 μin to about 6 μin.

3. The necking system of claim 1 wherein the relief has a surface finish Ra ranging from about 8 μin to about 32 μin.

4. The necking system of claim 1 wherein the plurality of necking dies are configured for producing a bottle necked package from a can comprising metal sheet, the can having an upper sidewall thickness of at least about 0.0085 inch, wherein the introductory die comprises the introductory percent reduction of greater than about 9%.

5. The necking system of claim 4 wherein the metal sheet has a post bake yield strength ranging from about 34 to about 37 ksi.

6. A method of necking a metal blank comprising the steps of:

providing a metal blank comprised of bottle stock;

shaping the metal blank into a container having an initial inside diameter; and necking the container into a bottle with at least one necking die having a necking surface and a relief; wherein the necking surface comprises a land, a neck radius portion, and a shoulder radius portion, each having an inner diameter; wherein the land is between the neck radius portion and the relief and the inner diameter of the land is a minimum diameter of the die; wherein the inner diameters of the neck radius portion and the shoulder radius portion are greater than the inner diameter of the land;

wherein the step of necking the bottle stock comprises inserting the container into the at least one necking die such that the entire land and the relief travel relative to the container in an axial direction wherein at least a portion of the relief travels beyond a top of the container and wherein the land contacts an outside of the bottle stock;

wherein the land has a surface finish Ra ranging from about 8 in to about 32 μin.

7. The method of claim 6 wherein the neck radius portion and the shoulder radius portion have a surface finish ranging Ra from about 2 μin to about 6 μin.

8. The method of claim 6 wherein the relief has a surface finish Ra ranging from about 8 μin to about 32 μin.

9. The method of claim 6 wherein the bottle stock comprises a geometry for an aerosol can or a beverage bottle.

* * * * *